US006598327B1

(12) United States Patent
Strzeletz

(10) Patent No.: US 6,598,327 B1
(45) Date of Patent: Jul. 29, 2003

(54) MOBILE ADVERTISING SYSTEM

(76) Inventor: Henryk Strzeletz, P.O. Box 363, Falls Hill Rd., Dallas, PA (US) 18612

( * ) Notice: Subject to any disclaimer, the term of this patent is extended or adjusted under 35 U.S.C. 154(b) by 0 days.

(21) Appl. No.: 09/636,593

(22) Filed: Aug. 10, 2000

Related U.S. Application Data

(63) Continuation-in-part of application No. 09/190,117, filed on Nov. 12, 1998, now Pat. No. 6,122,850.

(51) Int. Cl.[7] ..... G09F 21/04
(52) U.S. Cl. ..... 40/591; 40/558; 40/590
(58) Field of Search ..... 40/591, 590, 558, 40/545, 556; 296/21; 340/431, 425.5

(56) References Cited

U.S. PATENT DOCUMENTS

| | | | | | |
|---|---|---|---|---|---|
| 1,597,112 | A | * | 8/1926 | Rymal | 40/591 |
| 1,633,635 | A | * | 6/1927 | Harmon et al. | 40/591 |
| 2,753,640 | A | * | 7/1956 | McConnell | 40/578 |
| 3,054,205 | A | | 9/1962 | Sierpin | |
| 3,802,103 | A | | 4/1974 | Neff | |
| 4,114,299 | A | | 9/1978 | Brownlee | |
| 4,135,754 | A | * | 1/1979 | Fitzgerald et al. | 296/15 |
| 4,346,529 | A | * | 8/1982 | Keller | 40/588 |
| 4,475,299 | A | * | 10/1984 | Nelson | 40/591 |
| 4,557,517 | A | * | 12/1985 | Bolduc et al. | 362/485 |
| 4,580,361 | A | | 4/1986 | Hillstrom et al. | |
| 4,756,107 | A | | 7/1988 | Hillstrom | |
| 5,005,893 | A | | 4/1991 | McCrary | |
| 5,083,826 | A | | 1/1992 | McCrary | |
| 5,379,540 | A | | 1/1995 | Howard | |
| 5,600,909 | A | | 2/1997 | Hooper | |
| 5,649,730 | A | | 7/1997 | Ramos | |
| 5,657,566 | A | | 8/1997 | Key | |
| 5,692,331 | A | | 12/1997 | Tipke | |
| 5,815,969 | A | | 10/1998 | Brouwer | |
| 5,918,924 | A | | 7/1999 | Cowan | |
| 6,036,250 | A | * | 3/2000 | Glatter | 296/21 |
| 6,145,230 | A | * | 11/2000 | Holmberg | 40/591 |

* cited by examiner

*Primary Examiner*—William L. Miller
(74) *Attorney, Agent, or Firm*—Hunton & Williams LLP

(57) ABSTRACT

A mobile advertising system including a vehicle and a support structure mounted on the vehicle. The support structure extends substantially from the cab of the vehicle to the rear end of the vehicle and houses at least one light source. At least one translucent display panel is mounted to the support structure so that the light source illuminates the display panel from behind.

18 Claims, 7 Drawing Sheets

MOBILE ADVERTISING SYSTEM

RELATED APPLICATION

This application is a continuation-in-part of the U.S. patent application Ser. No. 09/190,117, entitled "MOBILE BILLBOARD SYSTEM" filed on Nov. 12, 1998, now U.S. Pat. No. 6,122,850.

FIELD OF THE INVENTION

This invention relates to an apparatus for displaying an advertisement or similar graphic on a moving object such as a truck, van or trailer and for a medium for displaying the advertisement wherein the advertisement may be changed periodically without having to remove the display, repaint the display or use another similarly cumbersome and/or expensive process.

BACKGROUND OF THE INVENTION

There are currently a great variety of different types of displays that can be used to exhibit advertising on the sides of moving vehicles such as vans, buses or trucks. The deficiencies inherent in many of the current display means are the lack of permanency of them. Many are fabricated by painting the advertisement directly on the surface of the vehicle, or by applying sign panels to the vehicle using adhesives. These displays are expensive, difficult to install, and difficult to change in a timely fashion. In addition, their useful life is limited by constant exposure to the elements even when not in use. A painted display may fade or the paint can fleck off. Rigid signs or signs with protective enclosures are more impervious to the elements, but are cumbersome and limited in size and can often be prohibitively heavy, weighing down the vehicle on which they are installed.

There are also prior means for displays using tensioning panels which may be adapted for use on mobile surfaces. These systems offer the ability to change the display in a more timely manner, and the ability to roll up the panel for storage helps reduce environmental wear. However, the tensioning frames are typically complex to assemble and often quite costly. For example, U.S. Pat. No. 4,580,361 to Hillstrom et al. discloses a tensioning frame which employs edge rails with integral spring tensioners to apply tension to the periphery of an advertising panel. This system, however, is complex to assemble and prone to mechanical failure after prolonged environmental exposure. Moreover, the edge rails protrude significantly from the mounting surface and may be unusable with some vehicles.

SUMMARY OF THE INVENTION

It is therefore an object of the present invention to provide an advertising medium with the benefits of mobility and non-permanent display which can be quickly and easily changed when different products or services are desired to be promoted.

It is an additional object of the present invention to provide a mobile advertising medium with a long useful life.

It is a further object of the present invention to provide a mobile advertising medium with a display that is relatively inexpensive to manufacture and easy to install.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purposes of the invention, as embodied and broadly described herein, the invention includes a mobile advertising system including a vehicle and a support structure. The support structure extends substantially from the cab of the vehicle to the rear end of the vehicle and houses at least one light source. At least one translucent display panel is mounted to the support structure so that the light source illuminates the display panel from behind.

The accompanying drawings, which are incorporated in and constitute a part of this specification, illustrate one embodiment of the invention and, together with the description, serve to explain the principles of the invention.

DESCRIPTION OF THE PREFERRED EMBODIMENTS

Figure 1:
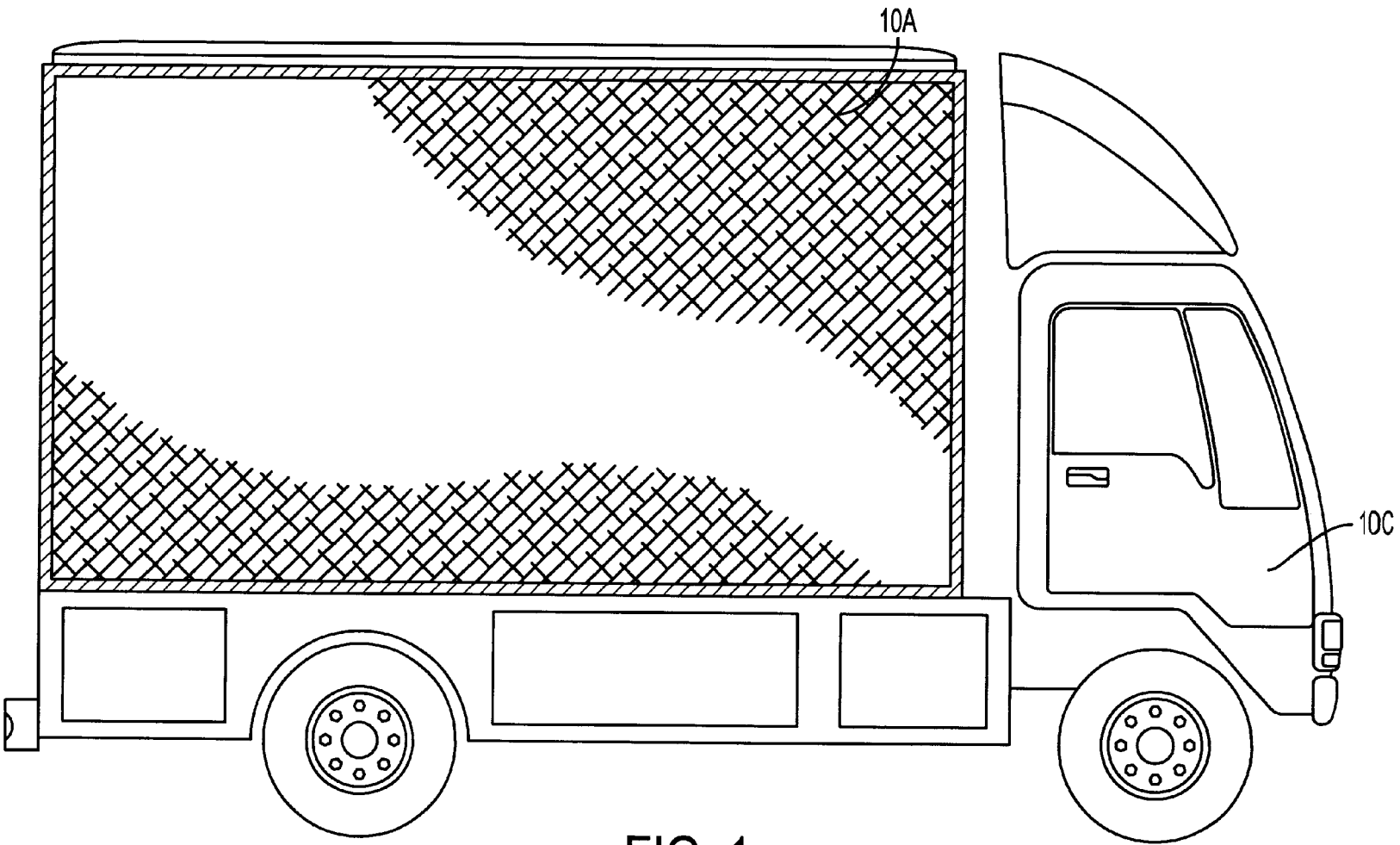
FIG. 1 is a side view of a truck utilizing the mobile advertising system of the present invention.

Reference will now be made in detail to the present preferred embodiment of the invention, an example of which is illustrated in the accompanying drawings in which like reference characters refer to corresponding elements.

The mobile advertising system of the present invention overcomes the deficiencies inherent in prior designs for mobile advertising in that the medium is such that it will not deteriorate due to exposure to the outside environment, it is relatively easy to change the message on the display by changing the back-lighting, and once the display panels are mounted on the motor vehicle, there is no further assembly required.

Figure 2A:
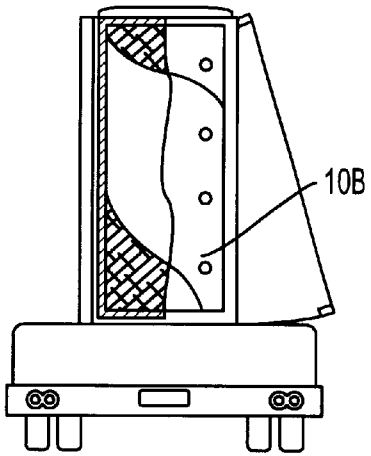
FIG. 2A is a rear view of the truck shown in FIG. 1.
Figure 2B:
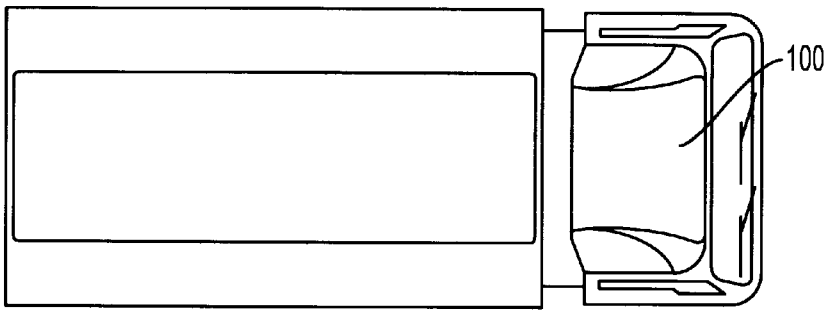
FIG. 2B is a top view of the truck shown in FIG. 1.
Figure 2C:
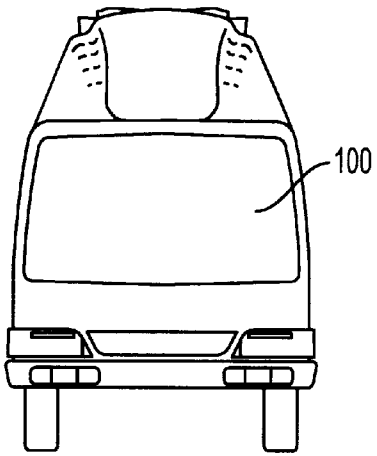
FIG. 2C is a front view of the truck shown in FIG. 1.
Figure 3A:
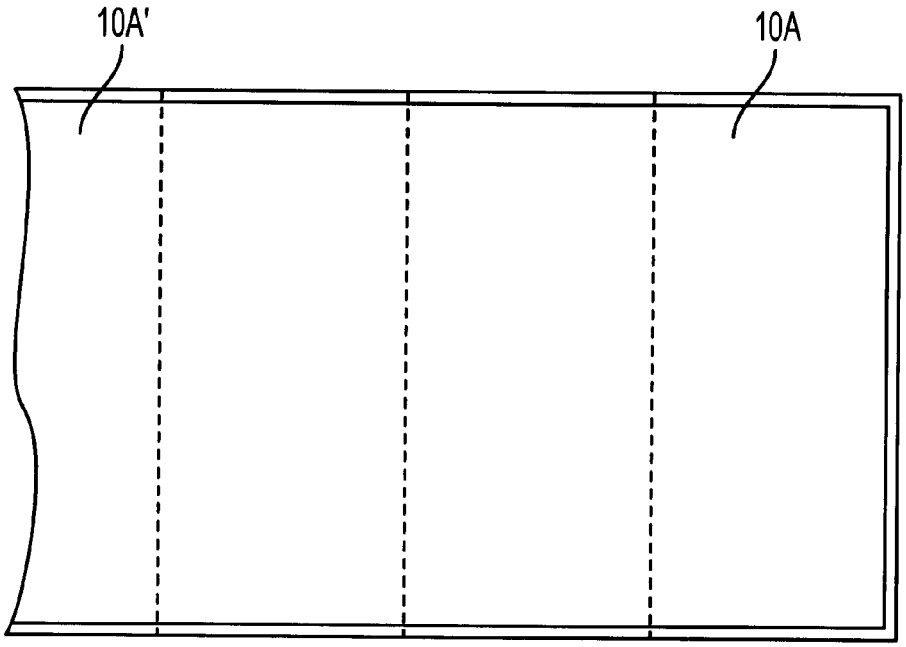
FIG. 3A is a more detailed drawing of a display panel for the mobile advertising system which is mounted on the side of the motor vehicle.
Figure 3B:
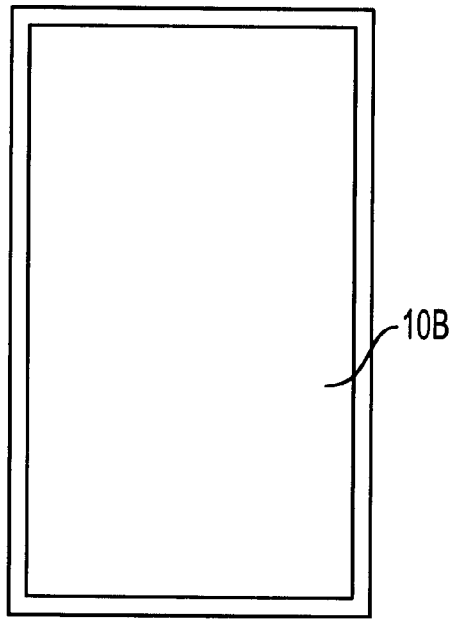
FIG. 3B is a more detailed drawing of the display panel of the mobile advertising system which is mounted the rear of the motor vehicle.

FIG. 1 illustrates a side view of a truck with a side display panel 10A of the mobile advertising system of the present invention mounted thereon. FIG. 3A illustrates the side display panel 10A. As shown, each side display panel 10A can be comprised of a plurality of individual sections of panel material 10A'. Each individual panel section 10A' can measure up to a maximum of 48 inches in width. Using four panel sections 10A' of 41 3/16 inches width each allows a side display panel 10A to be divided into four sections, of equal dimension with the entire side panel 10A having a 91 inches by 163 inches visible area dimension. Each side panel 10A also includes a 1¾ inch border around all four sides. A rear display panel 10B, as shown in FIGS. 2A and 3B, may also be mounted on a truck. Preferably the dimensions for such rear display panel 10B measure 24 inches by 81 inches for the visible area with a 1½ inch border around each side of the rear display panel 10B. The display dimensions for both display panels 10A and 10B may be varied depending upon the dimensions of the chassis for the vehicle onto which such display panels are to be mounted.

The visible area for both the side display panel 10A and the rear display panel 10B is comprised of lexan, plexiglass or other similar transparent or translucent, but resilient material. Each display panel 10A and 10B is mounted on top of support boxes, or frames, which are affixed to the vehicle.

The support boxes are attached to a support structure, which is attached to the bed or chassis of the vehicle. The support structure may be a box composed of a plurality of vertical and horizontal supports extending from the bed or chassis of the vehicle and defining first and second side walls, a rear wall, a front wall, and a roof. Each wall supports one or more of the display panels. The roof may incorporate an opaque roof panel, rather than a display panel and may include a plurality of support ribs extending between the top of the first side wall and the top of the second side wall to provide additional structural integrity. In one embodiment, the support structure may have angled side walls such that the support structure is comparatively narrow near the cab of the vehicle and the width of the support structure increases as it nears the rear of the vehicle, defining a trapezoidal cross section (See FIG. 4B).

Figure 4C:
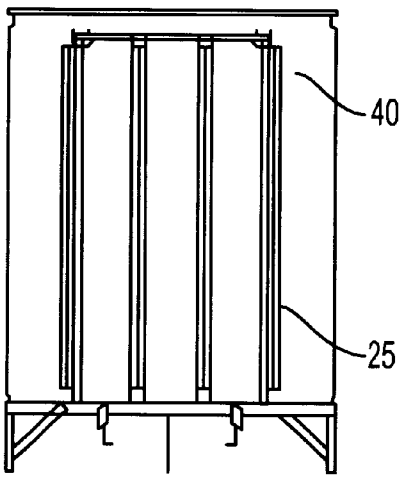
FIG. 4C is a rear view of the interior of the truck showing the lighting used to backlight a rear display panel.
Figure 4D:
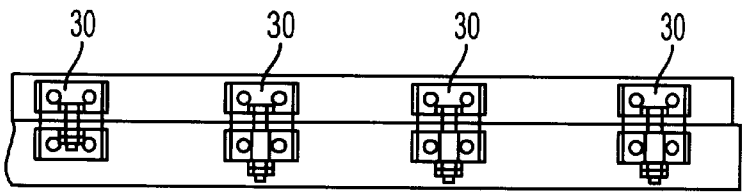
FIG. 4D illustrates mounting brackets used to mount the lighting assemblies.
Figure 4A:
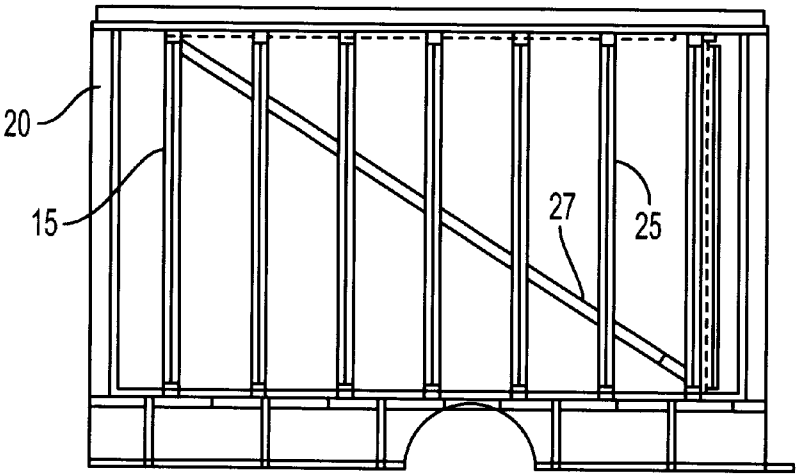
FIG. 4A is a side view of the interior of the truck showing the backlighting used to light a side display panel.
Figure 4B:
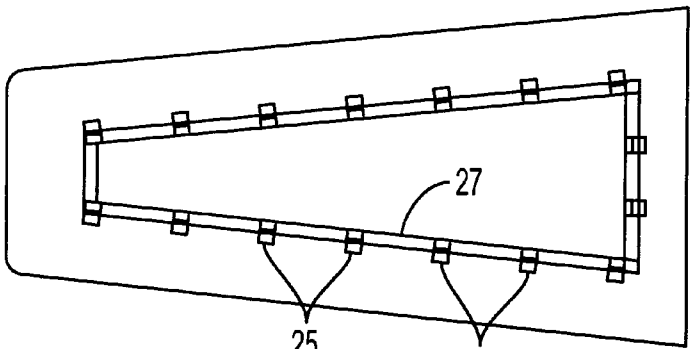
FIG. 4B is a top view of the interior of an alternate embodiment of the truck with a mounting structure having a trapezoidal cross-section.

The backlighting used to light the display panels, such as 10A and 10B, is illustrated in FIGS. 4A through 4D. A side view of the backlighting used for a side display panel 10A is shown in FIG. 4A. As shown, a side display panel 10A, such as shown in FIGS. 1 and 3A, is backlit by use of a plurality of long double-tube fluorescent lights 15. In the current example, 12 eight feet long fluorescent lights are used. They are mounted on a light mounting body 20 which is comprised of a rectangular frame and which includes a plurality of mounting brackets 30, shown in FIG. 4D, for securing the light mounting body 20 to the chassis frame of the vehicle. The light mounting body 20 may be spaced from the support structure holding the display panels. Preferably, the mounting brackets 30 are comprised of ABS steel and suitable insulation material because the mounting brackets 30 should be insulated from the aluminum of the vehicle chassis for safety reasons. The light mounting body 20 includes a plurality of aluminum support channels 25 into which each fluorescent light 15 is to be secured. In one embodiment, channels 25 may comprise a plurality of rigid vertical members, as shown. An angle clip is welded to structure 20 and bolted to each support channel 25 to provide additional support for maintaining the position of each fluorescent light 15. A single flat bar support 27 is welded in a diagonal manner to each light support channel 25. A top view of the interior of a vehicle which haw tow side display panels 10A and a rear display panel 10B mounted therein is shown in FIG. 4B. Alternate backlighting configurations are possible (See FIG. 7B).

A rear view showing the backlighting used for a year display panel 10B is shown in FIG. 4C. The rear backlighting assembly 40 comprises a bar assembly which is bolted to the two side light mounting bodies 20. Assembly 40 includes a plurality of aluminum support channels 25 into which each fluorescent light 15 is to be secured. Assembly 40 also includes a plurality of angle clips similar to those discussed above with respect to structure 20 to support the channels 25.

The interior of the vehicle will also house the generator which will supply current to power the fluorescent lights. The power supply for such generator can be a typical 110 volt DC alternator power supply or a 24 volt battery.

Figure 5A:
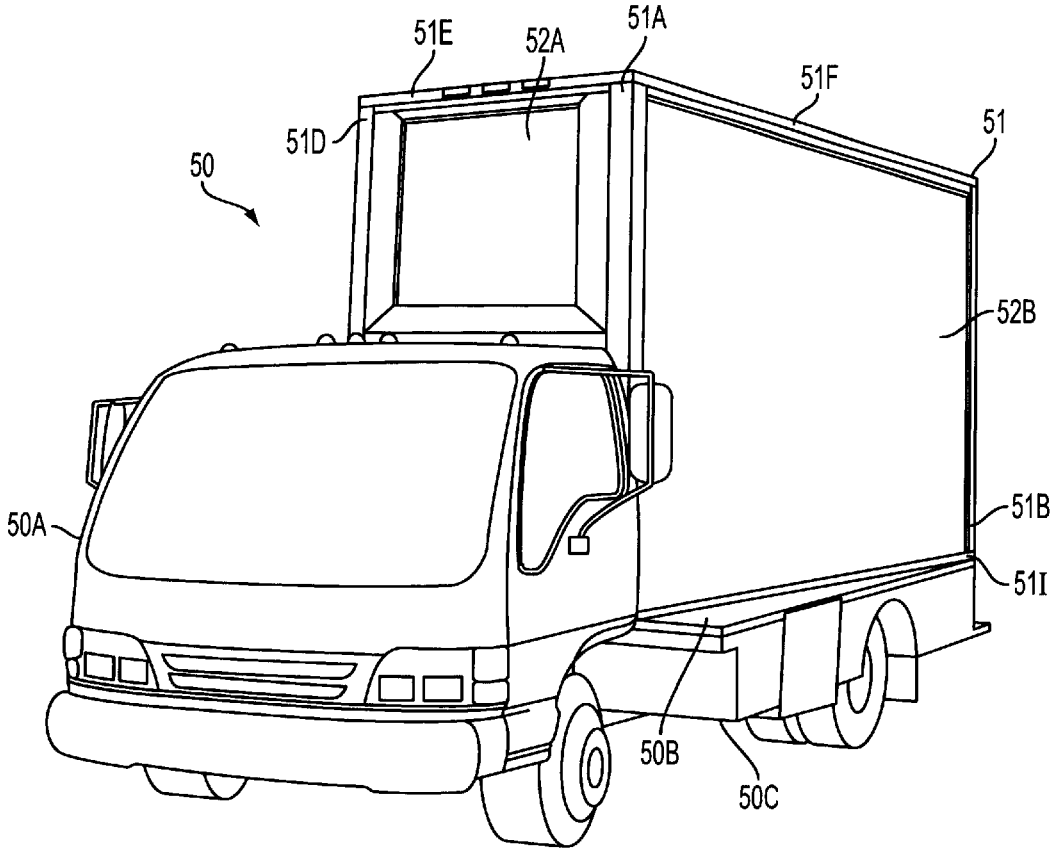
FIG. 5 is a front perspective view of a vehicle embodying an alternate embodiment of the invention.
Figure 6:
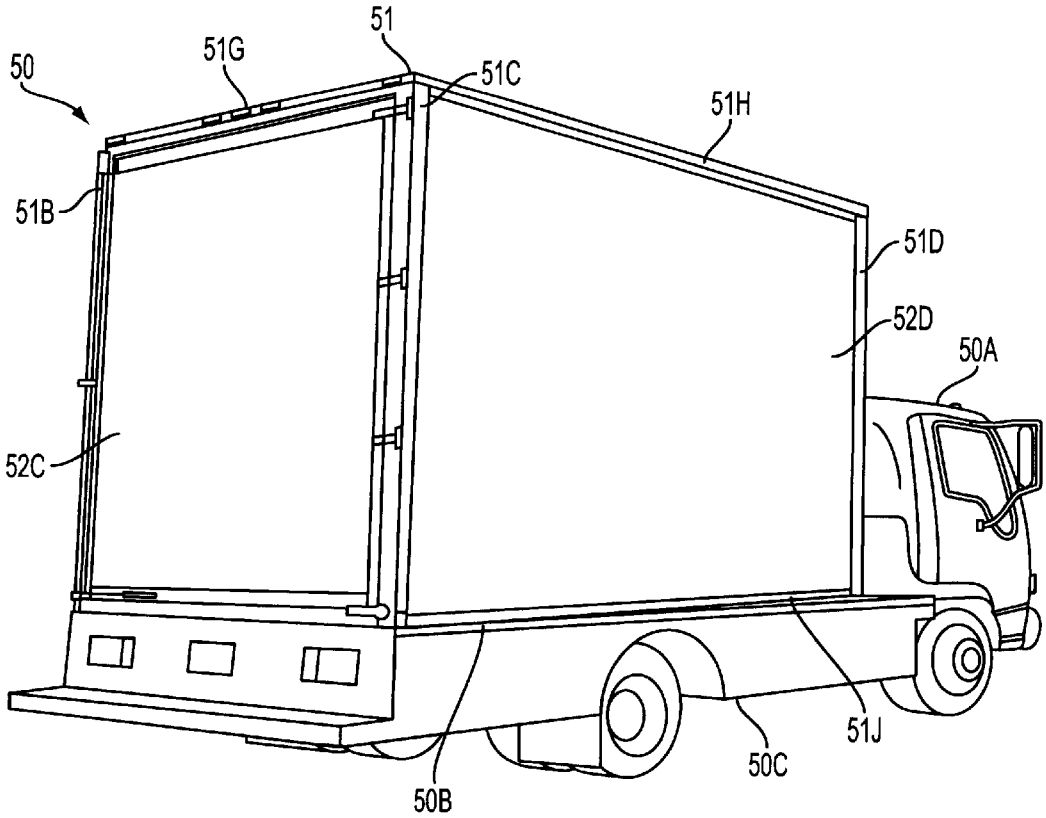
FIG. 6 is a rear perspective view of the vehicle of FIG. 5.

FIGS. 5 and 6 show an alternate embodiment of the invention having a support structure with a trapezoidal cross-section. This variation in support structure provides greater visibility for the side display panels to viewers in front of the vehicle. Vehicle 50 has a cab 50A and a bed 50B. Support structure 51 is anchored to the bed 50B or the vehicle chassis 50C. Support Structure 51 is comprised of four vertical support posts 51A, 51B, 51C, and 51D and six horizontal cross members, 51E, 51F, 51G, 51H, 51I, and 51J. The vertical support posts and horizontal cross members define a plurality of rectangular frames for supporting display panels 52A, 52B, and 52D. The horizontal cross members also define a roof panel (not shown). Support Structure 50 may also include a door 53 including a rectangular frame 53A supporting a display panel 52C. The door 53 may be hinged to vertical support post 51C and latch to vertical support post 51B. FIG. 7A shows a rear view of the vehicle with door 53 closed and FIG. 7B shows a rear view of the vehicle with door 53 in an open position (door 53 is only partially shown).

Figure 7B:
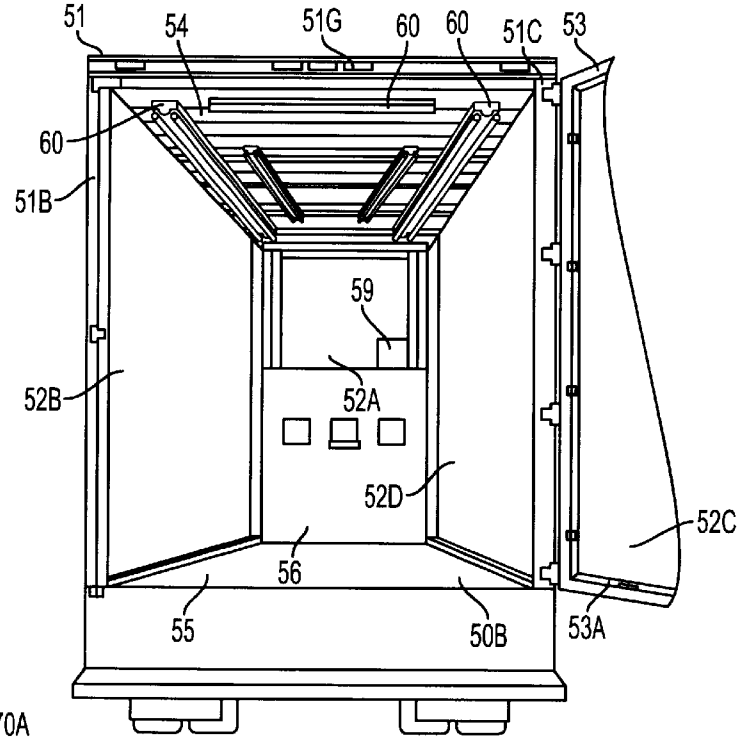
FIG. 7B is a rear view of the interior of vehicle of FIG. 5.

FIG. 7B shows an interior view of the vehicle including an alternate backlighting configuration. A plurality of light fixtures 60 are attached to ceiling 54. In one embodiment, light fixtures 60 include fluorescent light bulbs disposed in aluminum support channels. The light fixtures 60 are arranged to provide backlighting for the various display panels, the backs of which are shown in FIG. 7B. In one configuration, three fixtures are arranged parallel and adjacent to display panel 52B, three fixtures are arranged parallel and adjacent to display panel 52D, one fixture is arranged parallel and adjacent to display panel 52A, and one fixture is arranged parallel and adjacent to door 53 (in its closed position). The interior surfaces, such as ceiling 54, floor 55, and half wall 56 may be reflective or lightly colored in order to reflect the light generated by light fixtures 60. The space defined within support structure 51 may house a power source 59 for light fixtures 60 and/or may be used for general storage transport, such as for spare display panels.

Figure 7C:
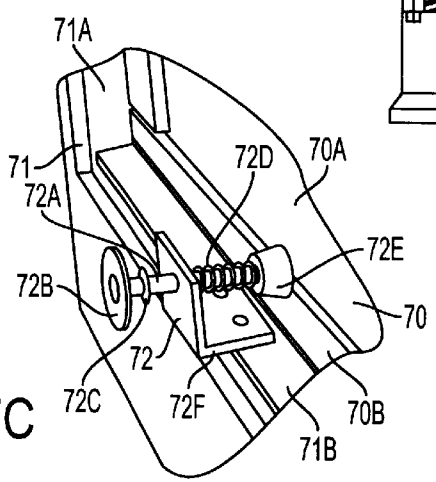
FIG. 7C is a perspective view of a mounting bracket for holding display panels in place.
Figure 7A:
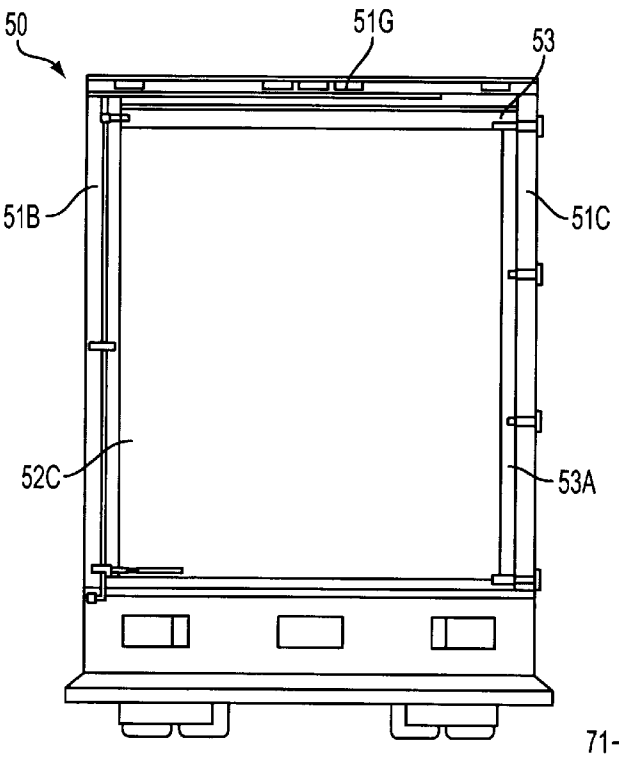
FIG. 7A is rear view of the vehicle of FIG. 5.

FIG. 7C shows a bracket for detachably affixing the display panels to support structure 51. While a single bracket is shown, a plurality of brackets lining horizontal cross beams and/or vertical support posts. As shown, display panel 70 includes a display area 70A and a frame 70B. Frame 70B fits into the space defined by the vertical support post 71A and horizontal cross beam 71B of support structure 71. Bracket 72 may be a spring loaded plunger designed to apply force to the frame 70B and hold it against a lip (not shown) on support structure 71. Bracket 72 may include a shaft 72A, with a handle 72B, a stop 72C, a spring 72D, and a contact member 72E. The shaft 72A is placed through a bracket guide 72F with the stop 72C and handle 72B on one side and the tensioned spring 72D and contact member 72E on the other side. Plunger 72A may be drawn back from display panel 70 by pulling handle 72B so as to overcome the force applied by the spring 72D. Bracket 72 provides a simple way to rapidly release and remove the display panel 70. Other types of brackets or other connectors are feasible, such as threaded fasteners, clamps, clips, magnetic fasteners, adhesive fasteners, hook and loop fasteners, and other releasable connectors.

It should be apparent to those skilled in the art that various modifications and variations may be made to the mobile advertising system of the present invention without departing from the scope or spirit of the invention. Thus, it is intended that the invention cover such modifications and variations of the invention, provided they come within the scope of the appended claims and their legally entitled equivalents.

What is claimed is:

1. A mobile advertising system comprising:

a vehicle having a cab and a rear end;

a support structure mounted on said vehicle, said support structure extending substantially from the cab of the vehicle to the rear end of the vehicle and housing at least one light source;

at least one translucent display panel mounted to said support structure, whereby the at least one light source illuminates said at least one translucent display panel from behind; and a light mounting body disposed within said support structure and the at least one light source is mounted to said light mounting body, said light mounting body comprises a plurality of rigid vertical members spaced from said at least one translucent display panel.

2. The mobile advertising system of claim 1, wherein said vehicle comprises a substantially flat bed for supporting said support structure.

3. The mobile advertising system of claim 1, further comprising a power source disposed within said support structure.

4. The mobile advertising system of claim 1, wherein said at least one display panel comprises a plurality of display panels, said support structure comprises a first lateral side and a second lateral side, and at least one of said plurality of translucent display panels is disposed on the first lateral side and at least one of said plurality of translucent display panels is disposed on the second lateral side.

5. The mobile advertising system of claim 1, wherein said support structure comprises a rear side having said at least one translucent display panel disposed thereon.

6. The mobile advertising system of claim 1, wherein said support structure comprises a front side having said at least one translucent display panel disposed thereon.

7. The mobile advertising system of claim 1, wherein said support structure comprises a door having said at least one translucent display panel disposed thereon.

8. The mobile advertising system of claim 1, further comprising at least one transparent cover disposed on said at least one translucent display panel.

9. The mobile advertising system of claim 1, wherein the at least one light source comprises at least one fluorescent light bulb disposed in the light mounting body.

10. The mobile advertising system of claim 1, wherein the support structure defines a non-display panel and the at least one light source is attached to the non-display panel.

11. The mobile advertising system of claim 10, wherein the non-display panel is a roof panel.

12. The mobile advertising system of claim 1, wherein said at least one translucent display panel is comprised of lexan.

13. The mobile advertising system of claim 1 wherein said at least one translucent display panel is comprised of plexiglass.

14. The mobile advertising system of claim 1, wherein said at least one translucent display panel is attached to said support structure by at least one releasable connector.

15. A mobile advertising vehicle comprising:

a cab;

a chassis;

a support structure mounted to said chassis and housing at least one light source;

at least one translucent display panel mounted to said support structure, whereby the at least one light source illuminates said at least one translucent display panel from behind; and a light mounting body disposed within said support structure and the at least one light source is mounted to said light mounting body, said light mounting body comprises a plurality of rigid vertical members spaced from said at least one translucent display panel.

16. The vehicle of claim 15, wherein said support structure extends from said cab to a rear portion of the vehicle and has a substantially trapezoidal cross-section in a horizontal plane.

17. The vehicle of claim 15, further comprising a first power source for providing power for vehicle locomotion and a second power source for providing power to the at least one light source.

18. The vehicle of claim 15, wherein said support structure defines an enclosed cargo area.

* * * * *